US006349495B1

(12) United States Patent
Fluhr

(10) Patent No.: US 6,349,495 B1
(45) Date of Patent: Feb. 26, 2002

(54) FIRING PIN CONTROL DEVICE FOR A FIREARM

(75) Inventor: Norbert Fluhr, Oberndorf/Neckar (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 09/669,064

(22) Filed: Sep. 22, 2000

Related U.S. Application Data

(63) Continuation of application No. PCT/EP99/00294, filed on Jan. 19, 1999.

(30) Foreign Application Priority Data

Mar. 24, 1998 (DE) ..... 198 12 951

(51) Int. Cl.[7] ..... F41A 17/64
(52) U.S. Cl. ..... 42/70.08; 42/25
(58) Field of Search ..... 42/69.03, 70.08, 42/25

(56) References Cited

U.S. PATENT DOCUMENTS

| | | | | |
|---|---|---|---|---|
| 1,363,040 A | | 12/1920 | Hammond | |
| 1,455,881 A | | 5/1923 | Hammond | |
| 3,889,412 A | * | 6/1975 | Filecci | 89/147 |
| 4,031,648 A | | 6/1977 | Thomas | 42/70 A |
| 4,389,919 A | | 6/1983 | Kast et al. | 89/185 |
| 4,589,387 A | | 5/1986 | Miura et al. | 123/198 F |
| 4,726,136 A | * | 2/1988 | Dornaus | 42/70.08 |
| 6,145,234 A | * | 11/2000 | Fluhr | 42/70.08 |

FOREIGN PATENT DOCUMENTS

| | | | | |
|---|---|---|---|---|
| DE | 107213 C | | 12/1899 | |
| DE | 201609 C | | 9/1908 | |
| DE | 5124 | | 5/1914 | |
| DE | 25177797 | * | 1/1976 | 42/69.03 |
| DE | 3504519 A1 | | 8/1986 | |
| DE | 35 35 012 C2 | | 6/1995 | |
| DE | 197 02 374 A1 | | 7/1998 | |
| EP | 0 192 343 | | 8/1986 | |
| EP | 0 751 366 A1 | | 1/1997 | |

OTHER PUBLICATIONS

English–language translation of the *International Preliminary Examination Report,* International Bureau of WIPO, dated Nov. 9, 2000, 5 pages.

*International Search Report,* corresponding to International Application Serial No.: PCT/EP 99/00294, European Patent Office, dated Jun. 15, 1999, 3 pages.

* cited by examiner

*Primary Examiner*—Stephen M. Johnson
(74) *Attorney, Agent, or Firm*—Marshall, Gerstein & Borun

(57) ABSTRACT

A firing pin control device for a small arm is disclosed. The small arm includes a hammer, a housing including a fixed part, a slide disposed in the housing, with the slide being moveable between an open position and a closed position, and a firing pin mounted to the slide and being moveable relative to the slide along a linear path between a first position in which contact between the firing pin and the hammer is prevented and a second position in which contact between the firing pin and the hammer is permitted. The firing pin control assembly includes a pair of sleeves mounted in the slide, with the firing pin being slidable relative to the sleeves. A forward one of the sleeves engages the firing pin and is moveable between a forward position in which the firing pin is disposed in the first position and a rearward position in which the firing pin is disposed in the second position. The firing pin control assembly includes a counterspring arranged to bias the forward sleeve toward the forward position. A portion of the sleeve cooperates with the fixed housing part to thereby move the firing pin to the second position in response to movement of the slide to the closed position.

16 Claims, 5 Drawing Sheets

FIRING PIN CONTROL DEVICE FOR A FIREARM

RELATED APPLICATIONS

This application claims priority from PCT Application Serial No. PCT/EP99/00294, filed Jan. 19, 1999.

FIELD OF THE INVENTION

The present invention relates generally to a small firearm having a firing pin mounted in a moveable slide mechanism. More specifically, the present invention relates to a device for controlling the position of the firing pin relative to the slide mechanism in preparation for firing of the firearm.

BACKGROUND OF THE INVENTION

On many automatic small firearms a slide mechanism is mounted within a housing of the firearm. The slide mechanism is shiftable between a forward or closed in which a cartridge is properly position for firing, and a retracted position. Movement between these two positions both allows for the ejection of a spent cartridge and the positioning of a fresh cartridge in the breech for firing. As is known, a hammer advances in response to operation of a trigger and strikes the rear end of a firing pin.

Typically, the firing pin is mounted to the slide assembly. A firing pin spring bears against the slide assembly and biases the firing pin rearwardly so that a rear end of the firing pin protrudes from the slide assembly, with the rear end of the firing pin protruding slightly from the slide. When the firing pin is so positioned, a front end of the firing pin is retracted away from a front end of the slide assembly. When the hammer strikes the rear end of the firing pin, the pin is accelerated in a forward direction against the force of the firing pin spring. The percussion cap of the cartridge is disposed adjacent the percussion plate at the front end of the slide assembly. Consequently, the front end or tip of the firing pin emerges from the front end of the slide so that the tip of the firing pin strikes the percussion cap of the cartridge, thus firing the firearm.

In order to prevent firing of the cartridge before the slide assembly is fully closed, a blocking assembly may be provided for preventing contact between the hammer and the firing pin until the slide assembly has reached its fully closed position. Typically, during regular or continuous firing, prior art blocking mechanisms cooperate with the trigger and act by preventing the trigger from releasing the hammer unless the slide is in the proper fully closed positions. Such blocking mechanisms are controlled by the position of the slide, so that, at least in principle, firing of the forearm is only possible when the slide is fully closed.

However, manufacturing tolerances, soiling and/or wear on the blocking mechanism or failure of a component can cause a situation in which, despite the blocking mechanism, the trigger causes release of the hammer when the slide is still open or unlocked or only partially locked. In general, experience has shown that prior art devices designed to prevent premature firing of a cartridge are not adequately reliable for a variety of reasons.

SUMMARY OF THE INVENTION

In accordance with an aspect of the invention, a small arm having a trigger operatively engaging a releasable hammer includes a housing including a fixed part, a slide disposed in the housing and having a rear end, with the slide being moveable between an open position and a closed position, a firing pin mounted to the slide and being moveable relative to the slide along a linear path between a partially retracted position in which a rear end of the firing pin is disposed to prevent contact with the hammer and a fully retracted position in which the rear end of the firing pin is disposed to permit contact with the hammer, the firing pin further being adapted to move to a firing position in response to impact of the hammer against the rear end of the firing pin, and a firing pin control assembly. The firing pin control assembly includes a spring biased sleeve slidably receiving the firing pin, with the sleeve being moveable between a forward position in which the sleeve moves the firing pin to the partially retracted position and a rearward position in which the sleeve moves the firing pin to the fully retracted position. The sleeve is moveable to the rearward position in response to forward movement of the slide to thereby maintain the firing pin in the partially retracted position until the slide is disposed in the closed position.

In further accordance with a preferred embodiment, the firing pin includes a spring positioned to apply a rearward biasing force to the firing pin, and further including a counterspring disposed to apply a forward biasing force to the sleeve, and wherein the counterspring has a spring constant greater than a spring constant of the firing pin spring. Preferably, the sleeve includes a lateral protrusion positioned to contact the fixed housing part in response to movement of the slide toward the forward position, thereby shifting the firing pin to the fully retracted position as the sleeve shifts from the forward position to the rearward position.

The rear end of the firing pin may be disposed within the slide when the firing pin is in the partially retracted position, and further the rear end of the firing pin may protrude from the rear end of the slide when the firing pin is in the fully retracted position. The fixed housing part may include a rearward face, with the rearward face being positioned to engage a lateral protrusion on the sleeve as the slide moves toward the closed position, thereby shifting the sleeve to the rearward position. The fixed housing part may include a forward face adapted to eject a cartridge in response to rearward movement of the slide. Further, the firing pin may include a safety ring abutting a forward portion of the sleeve, with the safety ring limiting rearward movement of the firing pin relative to the sleeve.

A second sleeve may be fixed to the slide with the second sleeve slidably receiving the firing pin. The counterspring may be disposed between the first and second sleeves for applying a forward biasing force to the first sleeve. The second sleeve may further positioned to limit the rearward movement of the first sleeve, and including a shoulder defined in the slide to limit the forward movement of the first sleeve, with the safety ring abutting cooperating portions of the first sleeve and the firing pin to limit rearward movement of the firing pin relative to the first sleeve.

According to another aspect of the invention, a small firearm having a firing pin control device comprises a hammer responsive to operation of a trigger, a housing, a slide assembly slidably disposed in the housing and moveable between a closed position and an open position, a firing pin mounted to the slide and being moveable relative to the slide along a linear path between a first position in which contact between a rear end of the firing pin and the hammer is prevented, and a second position in which contact between the rear end of the firing pin and the hammer is permitted, a firing pin spring positioned to apply a rearward biasing force to the firing pin, a forward sleeve slidably mounted to the slide and being moveable relative to the slide between a forward position and a rearward position, with the sleeve including a bore sized to slidably receive the firing pin therethrough, the sleeve further including a protrusion, a retaining sleeve mounted to the slide, and a counterspring engaging the forward sleeve and the retaining sleeve and being arranged to apply a forward biasing force to the sleeve thereby urging the forward sleeve toward the forward position. Accordingly, in response to movement of the slide toward the closed position the lateral protrusion contacts the fixed part of the housing thereby moving the forward sleeve toward the rearward position, so that the rear end of the firing pin is moved from the first position to the second position.

According to a further aspect of the invention, the small arm includes a hammer, a housing including a fixed part, a slide disposed in the housing, with the slide being moveable between an open position and a closed position, and a firing pin mounted to the slide and being moveable relative to the slide along a linear path between a first position in which contact between the firing pin and the hammer is prevented and a second position in which contact between the firing pin and the hammer is permitted. The firing pin control assembly includes a pair of sleeves mounted in the slide, with the firing pin being slidable relative to the sleeves. A forward one of the sleeves engages the firing pin and is moveable between a forward position in which the firing pin is disposed in the first position and a rearward position in which the firing pin is disposed in the second position. The firing pin control assembly includes a counterspring arranged to bias the forward sleeve toward the forward position. A portion of the sleeve cooperates with the fixed housing part to thereby move the firing pin to the second position in response to movement of the slide to the closed position.

BRIEF DESCRIPTION OF THE DRAWINGS

The invention is further explained with reference to the enclosed schematic drawings, in which.

DETAILED DESCRIPTION OF THE PREFERRED EMBODIMENTS

Figure 1:
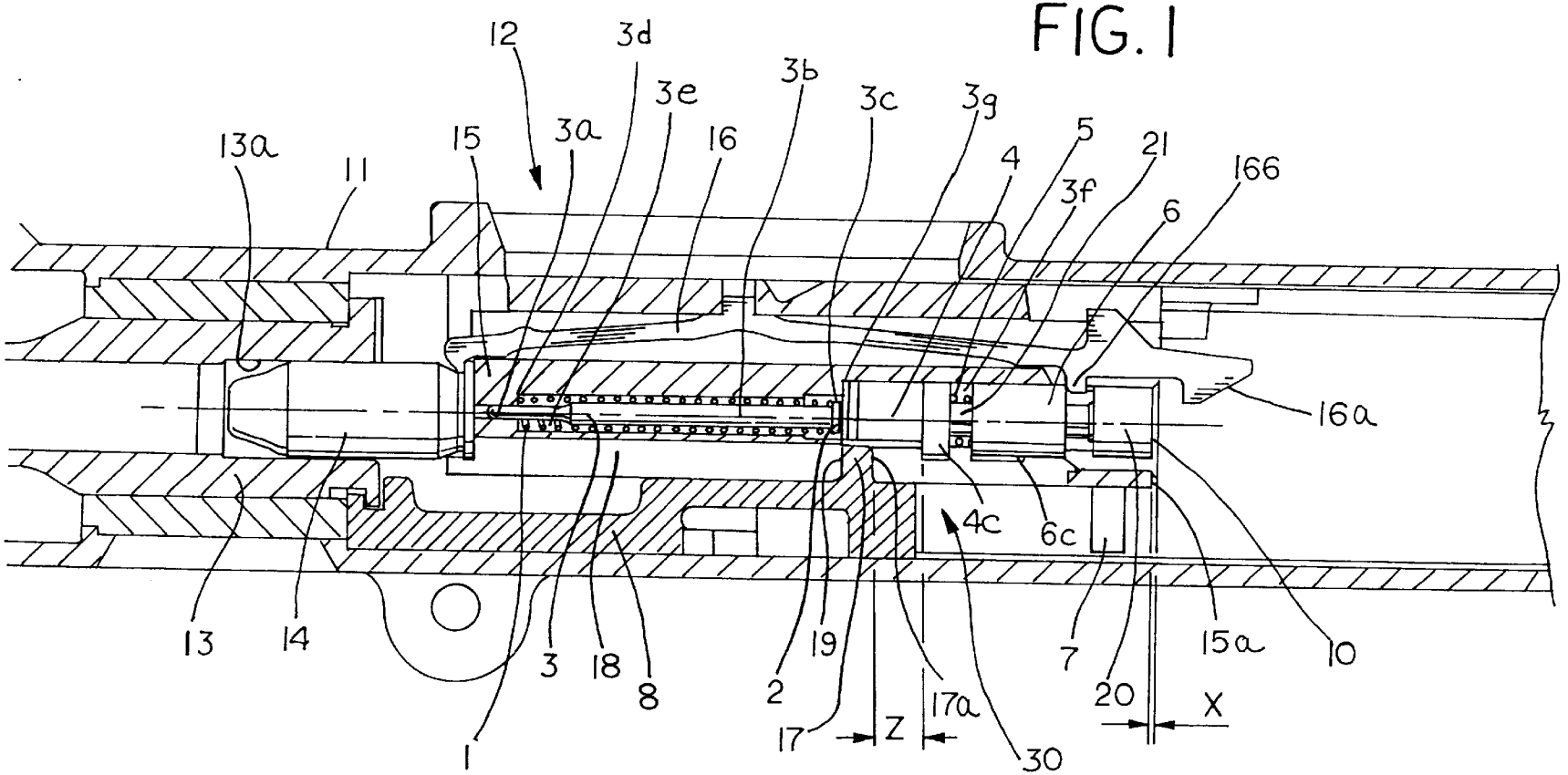
FIG. 1 is a fragmentary longitudinal sectional view from above of an automatic pistol incorporating a firing pin control device assembled in accordance with the teachings of the present invention; the slide assembly is shown approaching the fully closed position with a cartridge only partially introduced to the cartridge chamber.

As used throughout this description, position terms such as "top", etc., start from the horizontal use position of the weapon during firing, in which the firing direction points "forward" (i.e., to the left when viewing the accompanying drawings). Also, the following description will make repeated reference to a "hammer." It will be understood that, instead of a conventional hammer which pivots about an axis, alternative elements can also be provided, such as, for example, an element guided along a linear motion path and which can move under the load of firing spring. For the sake of simplicity, but without any restriction, only a "hammer" is spoken of below. The term serves merely for easier readability of the present description, but is not to be understood restrictively.

Referring now to the drawings, an automatic pistol generally is depicted in FIGS. 1 to 4 and includes a firing pin control device assembled in accordance with the teachings of the present invention which is referred to by the reference numeral 30. The automatic pistol includes a housing 11 in which a barrel 13 is fastened. The barrel 13 includes a cartridge chamber 13*a* on its rear end, into which a cartridge 14 can be introduced. An unlocked slide 15 (i.e. a solid slide) is mounted behind the barrel 13 and is movable in the longitudinal direction between the rearward, open position of FIG. 1, and the forward, closed position of FIG. 4. The slide 15 is guided for movement in the housing 11 and is biased in a forward direction against the barrel 13 by a closure spring (not shown). An ejector opening 12 is formed in the housing 11 to the side of the slide 15, with the ejector opening 12 being closed when the slide 15 is in the forward, closed position of FIG. 3, and with the ejector opening 12 gradually opening as the slide 15 moves rearwardly.

The slide 15 receives therethrough a firing pin 3. The firing pin 3 includes a firing pin spring 1 which biases the firing pin 3 in a rearward direction, such that the firing pin 3 would attempt to assume a fully retracted position similar to that shown in FIG. 3 in which a rear end 10 of the firing pin 3 protrudes from a rearward end 15*a* of the slide 15 by a distance Y.

Figure 3:
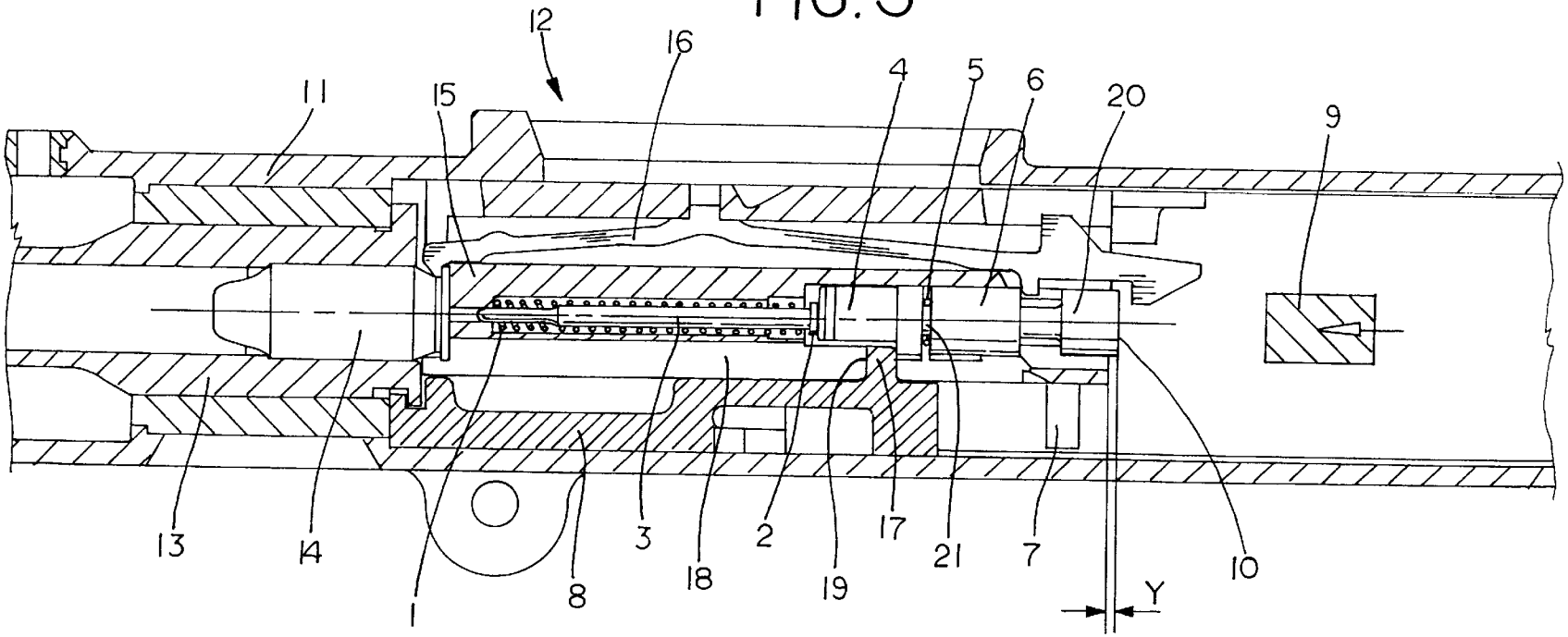
FIG. 3 is a sectional view similar to FIGS. 1 and 2 but illustrating the cartridge fully introduced to the cartridge chamber with the firearm ready to fire.
Figure 4:
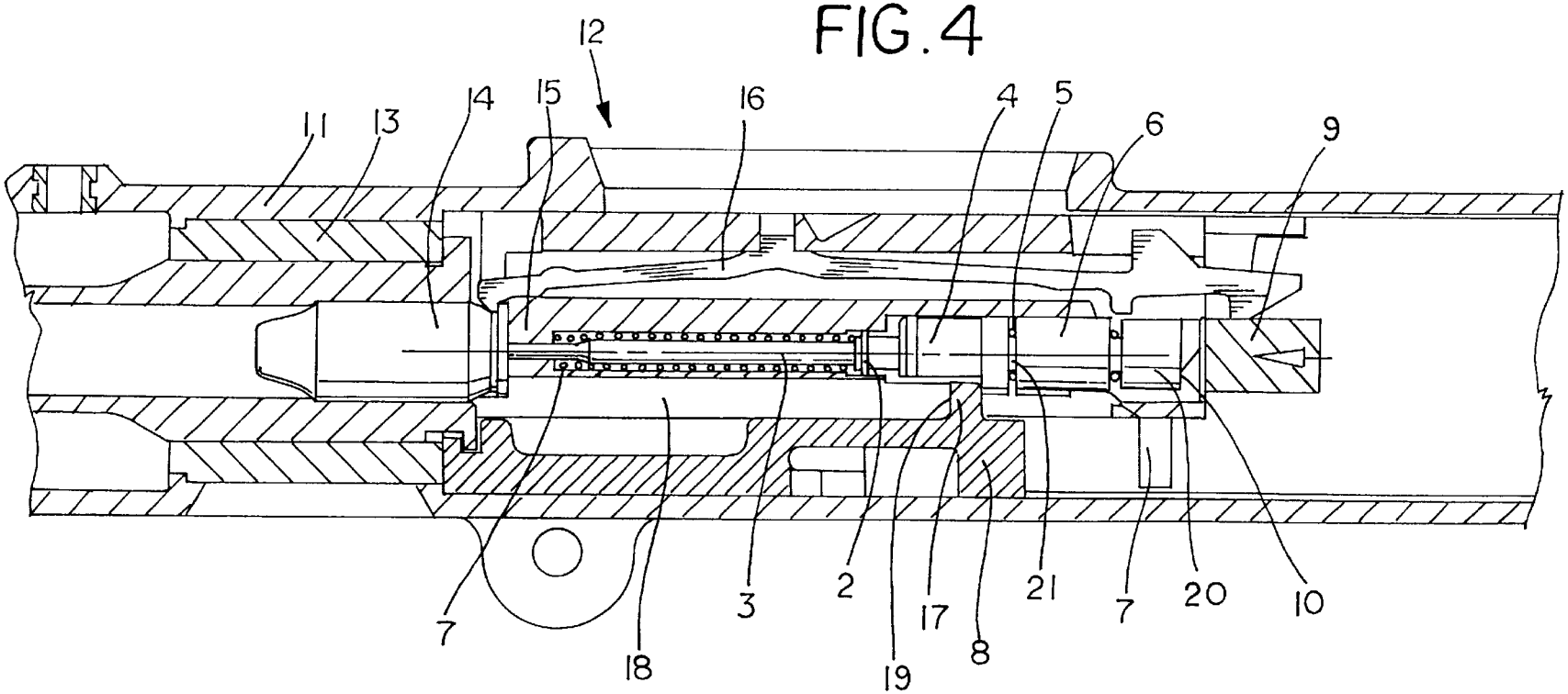
FIG. 4 is a sectional view similar to FIGS. 1 through 3 but illustrating the firearm during firing.

The automatic pistol also includes a hammer 9 mounted on a pivot, typically beneath the slide 15 and behind the forward position of the slide 15, with the hammer being shown schematically in FIGS. 3 and 4. The hammer 9 can advance into an advance position from a clamped position, so that the hammer 9 may strike the rear end 10 of the firing pin 3 when the rear end 10 protrudes from the slide 15 as shown in FIG. 3. When this occurs, the firing pin 3 is pushed forward, encounters a percussion cap on the cartridge 14, and fires the cartridge as shown in FIG. 4.

The firing pin 3 includes a thin tip 3*a*, then a thicker, but slender, central shaft 3*b*, which shaft 3*b* extends roughly to the center portion of the longitudinal extent of the firing pin 3, followed by a thickened, cylindrical section 21, and then terminates at a collar 20. The firing pin spring 1 is guided on the firing pin 3 and engages a shoulder 3*c* at the transition from the central shaft 3*b* to the cylindrical section 21. The firing pin spring 1 engages the shoulder 3*c* on the firing pin as well as a shoulder 3*d* defined at a forward portion of a bore 3e through the slide 15.

Figure 5:
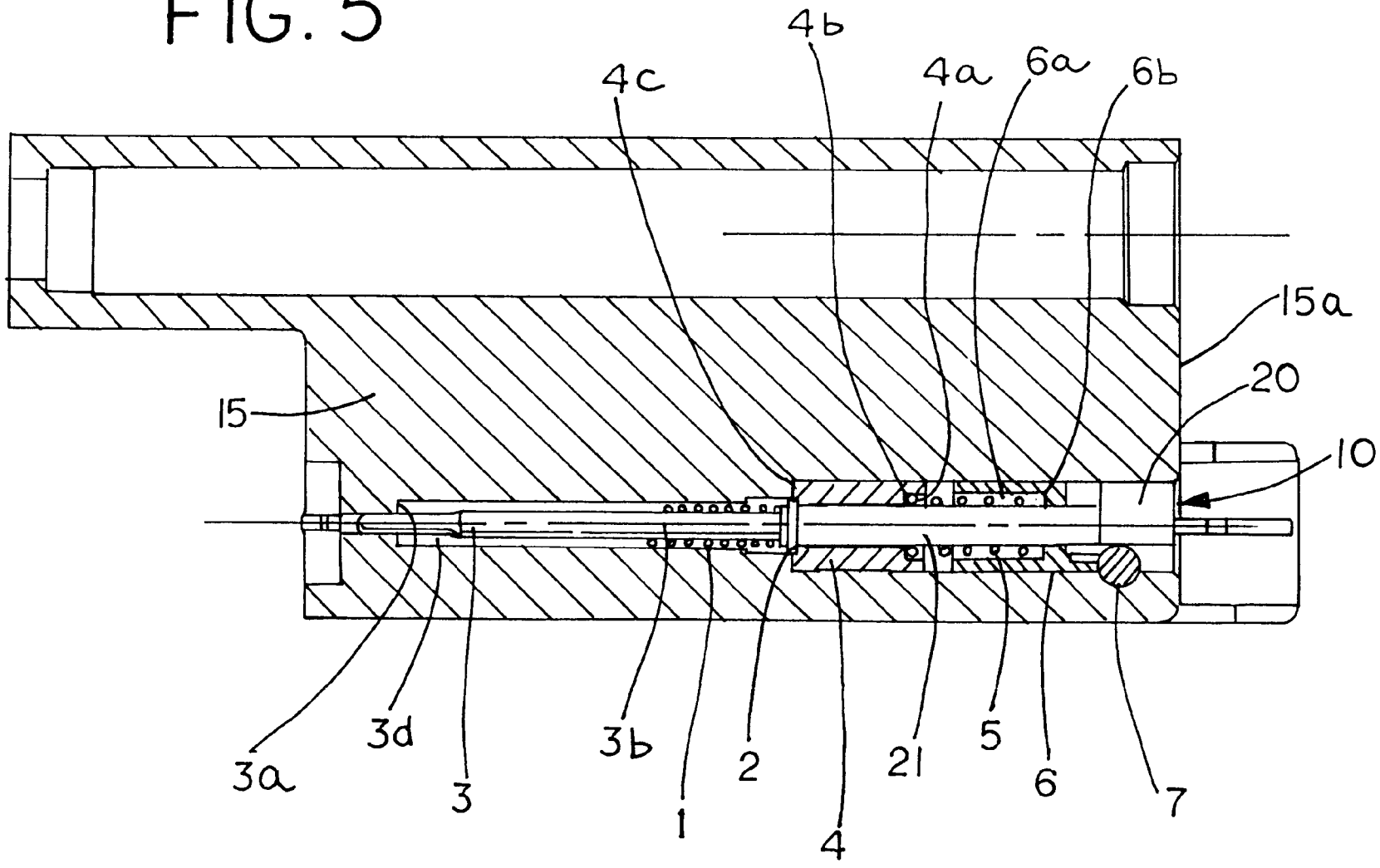
FIG. 5 is an enlarged elevational view in cross-section taken along a longitudinal axis of the slide assembly.

The slide 15 includes another larger bore 3*f* which defines a shoulder 3*g* at the transition between the bore 3*f* and the bore 3*e*. A retaining sleeve 6 is mounted within the bore 3*f*. As shown in FIG. 5, the retaining sleeve 6 includes a countersunk bore 6*a* having a shoulder 6*b*. A forward sleeve 4 includes a countersunk bore 4*a* having a shoulder 4*b*. A counterspring 5, such as a coil spring, is disposed between the forward sleeve 4 and the stop sleeve 6 engaging the respective shoulders 4*b*, 6*b* thereof. A forward portion 4*c* of the forward sleeve 4 abuts a safety ring 2 on the firing pin 3 to thereby limit the rearward movement of the firing pin relative to the forward sleeve 4. The safety ring preferably sits in an annular groove (not shown) at the transition point between the shaft 3*b* and the shaft 21. Preferably, the counterspring 5 will apply force to the left of the firing pin 3 that is greater than the force applied to the right by the firing pin spring 1. The safety ring 2 forms a front stop for the front sleeve 4 and holds the parts together as an assembly.

The front sleeve 4 includes a lateral protrusion 4*c* which is guided in a longitudinal groove 18. The retaining sleeve 6 may also include a protrusion 6*c*. The retaining sleeve 6 is secured in the slide 15 by means of a mounting pin 7.

The housing 11 includes a fixed engagement part 8 on the inside of the housing 11 opposite the ejection opening 12. The engagement part 8 may be made of steel sheet. A the engagement part 8 includes a fixed protrusion 17 that extends into the longitudinal groove 18 of the slide 15. A front edge 19 of the protrusion 17 may form an ejector edge, such that when the slide 15, with a cartridge 14 or an empty cartridge case, is moved rearward, the edge of the cartridge 14 or cartridge case strikes the front edge 19 of the protrusion 17 opposite the ejection opening 12 and is thus ejected through the ejector opening 12.

The protrusion 17 has an additional functional edge 17*a* on the back side opposite the front edge 19. The edge 17*a* positioned to engage the lateral protrusion 4*a* of the front sleeve 4, which thus prevents further forward movement of the sleeve 4. Preferably, the edge 17*a* of the engagement part 8 encounters the lateral protrusion of sleeve 4 when the slide 15 is still separated from the closed position by the distance X+Y.

The front end 8*a* of the engagement part 8 engages in a recess 13*a* of the barrel 13, so that the rear edge 17*a* of the protrusion 17 always remains at a fixed distance from the barrel 13, and therefore the edge 17*a* remains a fixed distance from the cartridge 14 during firing.

Figure 2:
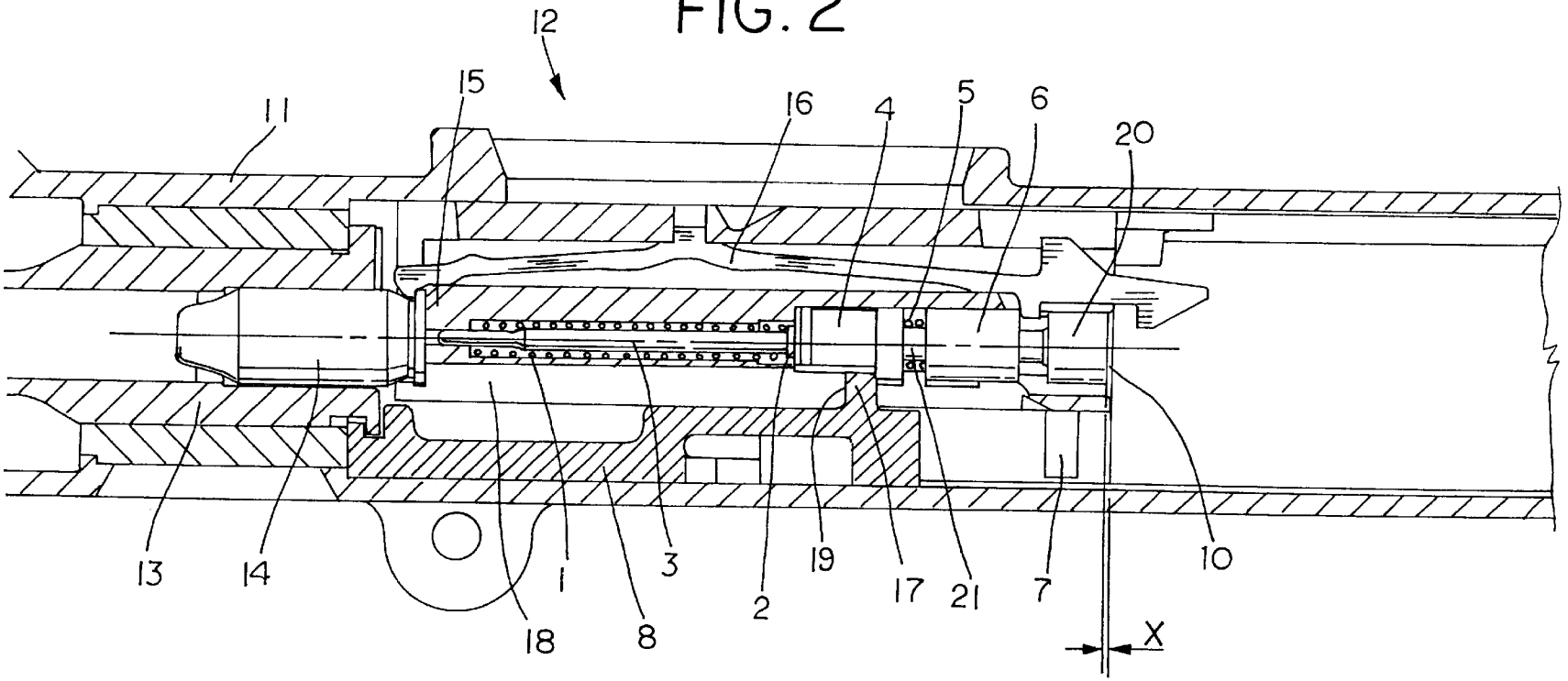
FIG. 2 is a sectional view similar to FIG. 1 but illustrating the slide assembly closer to the closed position and the cartridge almost completely introduced into the cartridge chamber.

The counterspring 5 is stronger than the firing pin spring 1, so that the counterspring 5 always tries to force the forward sleeve 4 forward against the action of firing pin spring 1, so that the forward sleeve 4 is normally retained in the forward position of FIG. 1, 2 or 5. When the slide 15 is removed from the weapon as shown in FIG. 5, the sleeve 4 sits at the forward position abutting the shoulder 3*g* in the bore 3*f* and forces the safety ring 2, and therefore the firing pin 3, forwardly. Consequently, the rear end 10 of the firing pin 3 is offset forwardly of the rear end 15*a* of the slide 15 by the dimension X. In this position of the firing pin 3, which is shown in FIG. 2, for example, the hammer 9, on advance, strikes the rear surface of the slide 15 without being able to reach the rear end 10 of the firing pin 3.

It will be noted that, in the preferred embodiment, the device 30 includes the collars 4 and 6, the counterspring 5, the cooperating portions of the slide 15, and the fixed part 17 of the housing 11.

It will be noted that the automatic pistol may include an ejector and safety device, such as the ejector and safety device shown in the form of a leaf spring 16 which is mounted adjacent to the slide 15. The leaf spring 16 includes a rear end 16*a* having a protrusion 16*b* that engages a front end 10*a* of the collar 20 of the firing pin 3, thus preventing forward movement of the firing pin 3. The advancing hammer 9 encounters an oblique surface 16*c* on the leaf spring 16 and deflects it, so that the protrusion 16*b* is moved out of engagement with the collar 20 and, on this account, the firing pin is released immediately before striking of hammer 9. This leaf spring 16 is described in German Patent Application 197 02 374.6-15 of the applicant; the disclosure of this patent application is expressly included by reference in the present document. This leaf spring 16 is modified in the invention so that it does not fully fix firing pin 3 in its rearmost position, but allows it a certain mobility (over the zone X+Y) in the longitudinal direction forward. The firing pin 3, however, is still prevented by the leaf spring 16 from moving out with its tip beyond the front end surface of slide 15 as long as hammer 9, by its advance, does not force leaf spring 16 from engagement with the firing pin 3. The front end of leaf spring 16 is designed as an ejector. On the longitudinal side opposite leaf spring 16, the slide has a longitudinal groove 18 discharging into its front end surface, into which an ejector protrusion 17 engages, which is designed on a fixed engagement part 18 attached in housing 11, which is formed as a steel sheet component, which engages with its front end in a recess in the outside of barrel 13 near its rear end. When the slide 15, after firing, moves back with the empty cartridge case, the longitudinal groove 18 passes over protrusion 17 rearward, until the bottom of the cartridge case encounters the front edge 19 of protrusion 17 and is ejected, being ejected through ejection opening 12.

In operation, and referring to FIG. 1, the slide 15 is shown during forward movement. The slide has just removed a cartridge 14 from the magazine (covered by the slide 15), grasped it with the extractor tab (on the front end of the leaf spring 16) and now guides it into the chamber of the barrel 13. The leaf spring 16 engages, with the protrusion in its rear region, the collar 20 of firing pin 3. The sleeve 4 is situated in its front end position and, in so doing, brings the firing pin 3, via safety ring 2, so far forward that its rear end 10 is displaced forward by the zone X relative to the rear end of the slide 15. Should the hammer 9 now be inadvertently advanced, the hammer 9 would strike the rear end of the slide 15. Thus, the hammer 9 would not touch the firing pin 3. The lateral protrusion of sleeve 4 guided in the longitudinal groove 18 is separated from the rear edge 17*a* of the protrusion 17 of the engagement part 8 by zone Z. The slide 15 must still cover the distance Z before the cartridge 14 may be fired.

In FIG. 2, the slide 15 has moved forward relative to its position in FIG. 1 by zone Z; all parts incorporated in slide 15 have the same relative positions as in FIG. 1. The protrusion 4*a* on the sleeve 4 has reached the edge 17*a* of the protrusion 17 of the engagement part 8.

In FIG. 3, the slide 15 has moved forward relative to the position shown in FIG. 2 by the zone X+Y and has reached its prescribed end or closed position in which the cartridge 14 fully sits in the chamber. The sleeve 4, during its last movement phase, has contacted the stationary edge 17*a*, thus moving the sleeve 4 rearwardly relative to the slide 15 and out of engagement with the shoulder 3*g* in the bore 3*f*. The firing pin spring 1, by pressing against the safety ring 2, forces the firing pin 3 rearward relative to the slide 15 so that the rear end 10 of the firing pin 3 now protrudes past the rearward end of the slide 15 by a zone Y.

In FIG. 4, the moment of firing of cartridge 14 is shown. The hammer 9 has moved in the direction of the arrow to its front end position, then moved over the oblique surface 16*b* on the rear end of the leaf spring 16, thus removing the protrusion 16*b* from the motion path of the collar 20 of the firing pin 3. The hammer strikes the rear end of the firing pin 3, and by the force of the impact accelerates the firing pin 3 forwardly against the force of the firing pin spring 1 so that the tip of the pin 3 impacts the percussion cap on the cartridge 14. The counterspring 5 does not act on the firing pin 3, since it is supported via the sleeve 6 in the slide 15.

If the slide 15 is now moved rearward by recoil of the fired cartridge 14, the hammer 9 is clamped again and the firing pin 3 is again pushed forward by the counterspring 5, as shown in FIGS. 1 and 2, as soon as the protrusion of sleeve 4 is released from the edge 17*a* on the protrusion 17 of the engagement part 8. The one-part design of the engagement part 8 and its fixed engagement in barrel 13 then helps to ensure the same relative position of the mentioned functional edge 17*a*.

In practical use, dirt can collect between the barrel 13 and the slide 15, or foreign objections can enter the chamber, which then prevents the slide 15 from fully reaching its front end or closed position. Here again, the protrusion Y is correspondingly reduced, so that ultimately, when the slide position no longer guarantees safe release of a shot, a shot can no longer be released either. This applies for all unlocked weapons, but also for locked weapons.

Thus, in accordance with a preferred embodiment firing of the firearm is only possible when the slide 15 has introduced the cartridge 14 sufficiently far into the chamber. The firing pin control device, which is independent of any trigger safety device, ensures that the firing pin 3 can reach its firing position to fire a cartridge 14 only when the slide 15 is fully closed, thus preventing cartridges from being fired with an incompletely closed slide, which could damage the weapon and endanger the shooter.

According to the preferred embodiment, the firing pin control device is independent of any trigger safety device, and prevents movement of the firing pin into its firing position unless the slide has reached its forward closed position and therefore has introduced the cartridge into the chamber far enough so that it is sufficiently supported. It will be understood that the forward closed position is not a point along the motion path of the slide, but rather is within a tolerance field, which is very narrow, however.

In accordance with the preferred embodiment, even when the slide has rebounded and opened slightly, the firing pin is immediately controlled and moved to the position where contact by the hammer is prevented.

As an alternative, a tilting lever may be provided that is mounted to pivot in the slide and that can be forced by a spring with a leg into blocking engagement with the slide. Another end may protrude on the front end surface or side surface of the slide above it. In the motion path of this protruding leg, a stop surface is provided on the barrel or housing, against which this protruding leg runs during closure of the slide and then lifts the other leg of the tilting lever from engagement with the firing pin. This arrangement of the stop surface is such that the firing pin is only released when the slide has reached the tolerance field at its end position.

It is therefore further prescribed according to the invention to bring the firing pin from the motion range of the advance device when firing is to be prevented. It would also be possible to remove the firing pin tip set up for firing from a position relative to the percussion cap of the cartridge, but advance of the advance device might then lead to damage to the firing pin.

The firing pin could be tilted so that it is displaced with its rear end across its direction of movement, as is known, with certain safeties. However, the firing pin is preferably displaced forward to an extent, so that it still lies reliably behind its firing position, but extends far enough into the slide that its rear end is protected from contact with the hammer or a firing pin piece by protrusions of the slide, preferably the rear end surface of the slide. This configuration is particularly preferred in a weapon in which the hammer lies fully within the housing, so that there is no hazard that a foreign object will reach the area between the hammer and firing pin and be still able to ensure firing.

Further, the fixed housing structure or part could be produced, for example, as an indentation of a housing made of sheet metal. However, this housing structure is preferably designed as an intrinsic component that can be produced accordingly from a highly wear-resistant material optimized for its purpose. This separate component can be attached unreleasably in the housing, for example, by composite casting, but can also be mounted releasably, so that, when it is worn or damaged, it can be replaced without difficulty with a new component or can be adjusted before final incorporation. This component is preferably provided with an engagement structure that engages in a counterstructure on the barrel, so that the critical spacing between the rear end of the barrel and thus the cartridge chamber and the surface or edge of the component, which compensates for the action of the counterspring, can be kept without effort within its very narrow tolerance field.

The mentioned separate component is preferably designed as a cartridge ejector, which must be formed anyway from a wear-resistant material, and, according to the invention, is designed on a surface or edge that serves to catch the counterspring or the part connected to it. The mentioned separate component can therefore be produced from an optimal material without requiring an additional component of the weapon. It is therefore possible to provide a weapon of the type mentioned at the outset with a new safety device in extremely economical fashion, which is fully independent of the trigger device and therefore also independent of the summing of tolerances and wear that ultimately can scarcely be avoided in a trigger device.

It will be understood that the above description does not limit the invention to the above-given details. It is contemplated that various modifications and substitutions can be made without departing from the spirit and scope of the following claims.

What is claimed:

1. A small arm having a trigger operatively engaging a releasable hammer, the small arm comprising:

a housing including a fixed part;

a slide disposed in the housing and having a rear end, the slide being moveable between an open position and a closed position;

a firing pin mounted to the slide and being moveable relative to the slide along a linear path between a partially retracted position in which a rear end of the firing pin is disposed to prevent contact with the hammer and a fully retracted position in which the rear end of the firing pin is disposed to permit contact with the hammer, the firing pin further being adapted to move to a firing position in response to impact of the hammer against the rear end of the firing pin; and a firing pin control assembly, the firing pin control assembly including a spring biased sleeve slidably receiving the firing pin, the sleeve being moveable between a forward position in which the sleeve moves the firing pin to the partially retracted position and a rearward position in which the sleeve moves the firing pin to the fully retracted position, the sleeve being moveable to the rearward position in response to forward movement of the slide to thereby maintain the firing pin in the partially retracted position until the slide is disposed in the closed position.

2. The small arm of claim 1, including a firing pin spring positioned to apply a rearward biasing force to the firing pin, and further including a counterspring disposed to apply a forward biasing force to the sleeve, and wherein the counterspring has a spring constant greater than a spring constant of the firing pin spring.

3. The small aim of claim 2, wherein the sleeve includes a lateral protrusion positioned to contact the fixed housing part in response to movement of the slide toward the forward position, thereby shifting the firing pin to the fully retracted position as the sleeve shifts from the forward position to the rearward position.

4. The small arm of claim 1, wherein the rear end of the firing pin is disposed within the slide when the firing pin is in the partially retracted position, and further wherein the rear end of the firing pin protrudes from the rear end of the slide when the firing pin is in the fully retracted position.

5. The small arm of claim 1, wherein the fixed housing part includes a rearward face, the rearward face being positioned to engage a lateral protrusion on the sleeve as the slide moves toward the closed position, thereby shifting the sleeve to the rearward position.

6. The small arm of claim 5, wherein the fixed housing part includes a forward face adapted to eject a cartridge in response to rearward movement of the slide.

7. The small arm of claim 1, wherein the firing pin includes a safety ring abutting a forward portion of the sleeve, the safety ring limiting rearward movement of the firing pin relative to the sleeve.

8. The small arm of claim 1, wherein the firing pin control assembly further includes a second sleeve fixed to the slide and slidably receiving the firing pin, and including a counter-spining disposed between the first and second sleeves for applying a forward biasing force to the first sleeve.

9. The small an- of claim 8, wherein the second sleeve is positioned to limit the rearward movement of the first sleeve, and including a shoulder defined in the slide to limit the forward movement of the first sleeve, and further including a safety ring a safety ring abutting cooperating portions of the first sleeve and the firing pin to limit rearward movement of the firing pin relative to the first sleeve.

10. A small firearm having a firing pin control device comprising:

a hammer responsive to operation of a trigger;

a housing;

a slide disposed in the housing and being moveable between an open position and a closed position;

a firing pin mounted to the slide and being moveable relative to the slide along a linear path between a first position in which contact between a rear end of the firing pin and the hammer is prevented, and a second position in which contact between the rear end of the firing pin and the hammer is permitted;

a firing pin spring positioned to apply a rearward biasing force to the firing pin;

a forward sleeve slidably mounted to the slide and being moveable relative to the slide between a forward position and a rearward position, the sleeve including a bore sized to slidably receive the firing pin therethrough, the sleeve further including a protrusion;

a retaining sleeve mounted to the slide; and a counterspring engaging the forward sleeve and the retaining sleeve and being arranged to apply a forward biasing force to the sleeve thereby urging the forward sleeve toward the forward position;

whereby in response to movement of the slide toward the closed position the lateral protrusion contacts the fixed part of the housing thereby moving the forward sleeve toward the rearward position, so that the rear end of the firing pin is moved from the first position to the second position.

11. The small firearm of claim 10, wherein the firing pin includes a safety ring abutting a portion of the forward sleeve, the safety ring limiting rearward movement of the firing pin relative to the forward sleeve.

12. The small firearm of claim 10, wherein the retaining sleeve is positioned to limit the rearward movement of the forward sleeve relative to the slide, and wherein the slide includes a shoulder arranged to limit the forward movement of the forward sleeve relative to the slide, and wherein the firing pin includes a safety ring abutting a portion of the forward sleeve to limit rearward movement of the firing pin relative to the forward sleeve.

13. The small firearm of claim 10, wherein the rear end of the firing pin is disposed within the slide when the firing pin is in the first position, and further wherein the rear end of the firing pin protrudes from a rear end of the slide when the firing pin is in the second position.

14. The small firearm of claim 10, wherein the fixed housing part includes a rearward face, the rearward face being positioned to engage the protrusion on the forward sleeve as the slide moves toward the closed position, thereby shifting the forward sleeve to the rearward position.

15. The small firearm of claim 10, wherein the fixed housing part includes a forward face adapted to eject a cartridge in response to rearward movement of the slide.

16. A small arm comprising:

a hammer;

a housing including a fixed part;

a slide disposed in the housing, the slide being moveable between an open position and a closed position;

a firing pin mounted to the slide and being moveable relative to the slide along a linear path between a first position in which contact between the firing pin and the hammer is prevented and a second position in which contact between the firing pin and the hammer is permitted; and a firing pin control assembly, the firing pin control assembly including a pair of sleeves mounted in the slide, the firing pin being slidable relative to the sleeves, a forward one of the sleeves engaging the firing pin and being moveable between a forward position in which the firing pin is disposed in the first position and a rearward position in which the firing pin is disposed in the second position, the firing pin control assembly including a counterspring arranged to bias the forward sleeve toward the forward position; a portion of the sleeve cooperating with the fixed housing part to thereby move the firing pin to the second position in response to movement of the slide to the closed position.

* * * * *